US010450806B2

(12) United States Patent
Bomidi et al.

(10) Patent No.: US 10,450,806 B2
(45) Date of Patent: Oct. 22, 2019

(54) CUTTING ELEMENT ASSEMBLIES COMPRISING ROTATABLE CUTTING ELEMENTS

(71) Applicant: Baker Hughes, a GE company, LLC, Houston, TX (US)

(72) Inventors: John Abhishek Raj Bomidi, Spring, TX (US); Alexander Rodney Boehm, Wheat Ridge, CO (US); Kegan L. Lovelace, Houston, TX (US); William A. Moss, Jr., Conroe, TX (US); Jon David Schroder, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 146 days.

(21) Appl. No.: 15/662,681

(22) Filed: Jul. 28, 2017

(65) Prior Publication Data

US 2019/0032415 A1 Jan. 31, 2019

(51) Int. Cl.
*E21B 10/55* (2006.01)
*E21B 10/43* (2006.01)

(52) U.S. Cl.
CPC ..... *E21B 10/55* (2013.01); *E21B 10/43* (2013.01)

(58) Field of Classification Search
CPC ..... E21B 10/55
USPC ..... 175/374
See application file for complete search history.

(56) References Cited

U.S. PATENT DOCUMENTS

| | | | | |
|---|---|---|---|---|
| 4,553,615 | A | 11/1985 | Grainger | |
| 4,751,972 | A | 6/1988 | Jones et al. | |
| 7,604,073 | B2 | 10/2009 | Cooley et al. | |
| 7,703,559 | B2 | 4/2010 | Shen et al. | |
| 7,762,359 | B1 * | 7/2010 | Miess | E21B 10/633 175/354 |
| 7,845,436 | B2 | 12/2010 | Cooley et al. | |
| 7,987,931 | B2 | 8/2011 | Cooley et al. | |
| 8,061,452 | B2 | 11/2011 | Cooley et al. | |

(Continued)

FOREIGN PATENT DOCUMENTS

| | | | |
|---|---|---|---|
| CN | 104781496 | A | 7/2015 |
| CN | 104995369 | A | 10/2015 |

(Continued)

OTHER PUBLICATIONS

International Written Opinion for International Application No. PCT/US2018/043417 dated Oct. 31, 2018, 7 pages.

(Continued)

*Primary Examiner* — Taras P Bemko
(74) *Attorney, Agent, or Firm* — TraskBritt

(57) ABSTRACT

A cutting element assembly includes a sleeve, a rotatable cutting element disposed within the sleeve, and a retention element. The sleeve and rotatable cutting element each have frustoconical surfaces. In some embodiments, a rotatable cutting element defines a first generally cylindrical surface, a second generally cylindrical surface, and an axial bearing surface opposite the end cutting surface and intersecting each of the first generally cylindrical surface and the second generally cylindrical surface. A bearing element may be disposed between an upper surface of a sleeve and a bearing surface of the rotatable cutting element. Earth-boring tools having rotating cutting elements are also disclosed.

11 Claims, 6 Drawing Sheets

(56) References Cited

U.S. PATENT DOCUMENTS

| | | | |
|---|---|---|---|
| 8,079,431 | B1 | 12/2011 | Cooley et al. |
| 8,091,655 | B2 | 1/2012 | Shen et al. |
| 8,210,285 | B2 | 7/2012 | Cooley et al. |
| 8,413,746 | B2 | 4/2013 | Shen et al. |
| 8,561,728 | B2 | 10/2013 | Cooley et al. |
| 8,800,691 | B2 | 8/2014 | Shen et al. |
| 8,881,849 | B2 | 11/2014 | Shen et al. |
| 8,931,582 | B2 | 1/2015 | Cooley et al. |
| 8,950,516 | B2 | 2/2015 | Newman |
| 8,973,684 | B1 | 3/2015 | Cooley et al. |
| 8,991,523 | B2 | 3/2015 | Shen et al. |
| 9,016,409 | B2 | 4/2015 | Zhang et al. |
| 9,033,070 | B2 | 5/2015 | Shen et al. |
| 9,187,962 | B2 | 11/2015 | Burhan et al. |
| 9,279,294 | B1 | 3/2016 | Cooley et al. |
| 9,291,000 | B2 | 3/2016 | Zhang et al. |
| 9,322,219 | B2 | 4/2016 | Burhan et al. |
| 9,328,564 | B2 | 5/2016 | Zhang et al. |
| 9,382,762 | B2 | 7/2016 | Cooley et al. |
| 9,388,639 | B2 | 7/2016 | Patel et al. |
| 9,464,486 | B2 | 10/2016 | Zhang et al. |
| 9,920,579 | B2 | 3/2018 | Newman |
| 2008/0251293 | A1 | 10/2008 | Mumma et al. |
| 2009/0205870 | A1 | 8/2009 | Smith |
| 2009/0321146 | A1 | 12/2009 | Dick et al. |
| 2012/0132471 | A1* | 5/2012 | Zhang ..... E21B 10/573 175/338 |
| 2014/0054094 | A1 | 2/2014 | Burhan et al. |
| 2014/0131118 | A1 | 5/2014 | Chen et al. |
| 2014/0326515 | A1 | 11/2014 | Shi et al. |
| 2014/0326516 | A1 | 11/2014 | Haugvaldstad et al. |
| 2014/0360789 | A1 | 12/2014 | Siracki et al. |
| 2014/0360792 | A1 | 12/2014 | Azar et al. |
| 2015/0047910 | A1 | 2/2015 | Chen et al. |
| 2015/0330153 | A1 | 11/2015 | Miller et al. |
| 2016/0290056 | A1 | 10/2016 | Propes et al. |
| 2017/0191317 | A1* | 7/2017 | Burhan ..... E21B 10/50 |

FOREIGN PATENT DOCUMENTS

| | | | |
|---|---|---|---|
| GB | 2512978 | A | 10/2014 |
| WO | 2016/081807 | A1 | 5/2016 |

OTHER PUBLICATIONS

International Search Report for International Application No. PCT/US2018/043417 dated Oct. 31, 2018, 3 pages.

* cited by examiner

CUTTING ELEMENT ASSEMBLIES COMPRISING ROTATABLE CUTTING ELEMENTS

FIELD

Embodiments of the present disclosure relate generally to rotatable cutting elements and earth-boring tools having such cutting elements.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

In addition to drill strings, other tool strings may be disposed in an existing well bore for, among other operations, completing, testing, stimulating, producing, and remediating hydrocarbon-bearing formations.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on the body of a drill bit by brazing. The drill bit body is formed with recesses therein, commonly termed "pockets," for receiving a substantial portion of each cutting element in a manner which presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting element via a torch to raise the temperature to a point high enough to braze the cutting elements to the bit body in a fixed position but not so high as to damage the PCD layer.

Unfortunately, securing a PDC cutting element to a drill bit restricts the useful life of such cutting element, because the cutting edge of the diamond table and the substrate wear down, creating a so-called "wear flat" and necessitating increased weight-on-bit to maintain a given rate of penetration of the drill bit into the formation due to the increased surface area presented. In addition, unless the cutting element is heated to remove it from the bit and then rebrazed with an unworn portion of the cutting edge presented for engaging a formation, more than half of the cutting element is never used.

Rotatable cutting elements mounted for rotation about a longitudinal axis of the cutting element can wear more evenly than fixed cutting elements, and exhibit a significantly longer useful life without removal from the drill bit. That is, as a cutting element rotates in a bit body, different parts of the cutting edges or surfaces may be exposed at different times, such that more of the cutting element is used. Thus, rotatable cutting elements may have a longer life than fixed cutting elements.

BRIEF SUMMARY

A cutting element assembly includes a sleeve, a rotatable cutting element disposed within the sleeve, and a retention element. The sleeve defines a first internal groove and a first frustoconical surface longitudinally spaced from the first internal groove. The rotatable cutting element includes a polycrystalline hard material and a supporting substrate. The polycrystalline hard material has an end cutting surface. The rotatable cutting element defines a second groove in a surface of the supporting substrate and a second frustoconical surface longitudinally spaced from the second internal groove. The retention element is disposed partially within the first groove and partially within the second groove.

In some embodiments, a cutting element assembly includes a sleeve defining a cylindrical cavity therein and a rotatable cutting element disposed at least partially within the cavity of the sleeve. The sleeve defines a generally planar end surface. The rotatable cutting element includes a polycrystalline hard material bonded to a substrate. The polycrystalline hard material has an end cutting surface generally parallel to the end surface of the sleeve. The substrate defines a bearing surface and a cylindrical portion extending into the cylindrical cavity of the sleeve. The bearing surface is opposite the end cutting surface. A bearing element is disposed between the upper surface of the sleeve and the bearing surface of the rotatable cutting element.

In certain embodiments, a cutting element assembly includes a sleeve and a rotatable cutting element. The sleeve defines a first interior cylindrical surface, a second interior cylindrical surface, and a generally planar axial bearing surface between the first interior cylindrical surface and the second interior cylindrical surface. The first interior cylindrical surface, the axial bearing surface, and the second interior cylindrical surface together at least partially define a cavity in the sleeve. The rotatable cutting element is disposed at least partially within the cavity. The rotatable cutting element includes a polycrystalline hard material mounted to a substrate and having an end cutting surface generally parallel to the axial bearing surface of the sleeve. The substrate defines a first generally cylindrical surface, a second generally cylindrical surface, and an axial bearing surface opposite the end cutting surface and extending between the first generally cylindrical surface and the second generally cylindrical surface. The substrate is substantially disposed within an interior of each of the first interior cylindrical surface and the second interior cylindrical surface, and the axial bearing surface of the rotatable cutting element is in contact with the axial bearing surface of the sleeve.

DETAILED DESCRIPTION

Figure 1:
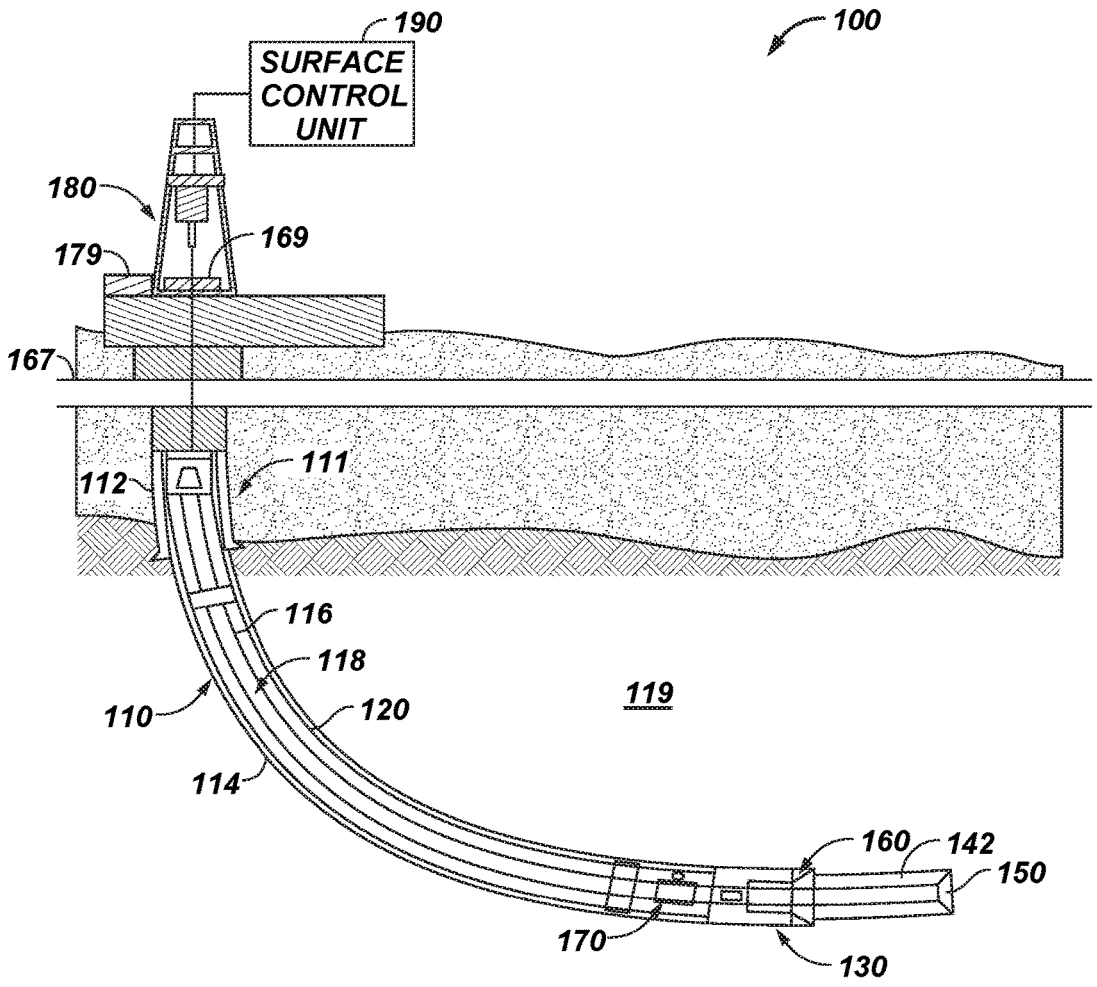
FIG. 1 is a simplified schematic diagram of an example of a drilling system using cutting element assemblies disclosed herein.

The illustrations presented herein are not actual views of any particular cutting assembly, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 $Kg_f/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a schematic diagram of an example of a drilling system 100 using cutting element assemblies disclosed herein. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 at its bottom end. The tubular member 116 may be coiled tubing or may be formed by joining drill pipe sections. A drill bit 150 (also referred to as the "pilot bit") is attached to the bottom end of the drilling assembly 130 for drilling a first, smaller diameter borehole 142 in the formation 119. A reamer bit 160 may be placed above or uphole of the drill bit 150 in the drill string 118 to enlarge the borehole 142 to a second, larger diameter borehole 120. The terms wellbore and borehole are used herein as synonyms.

The drill string 118 extends to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively drill boreholes 142 and 120. The rig 180 also includes conventional devices, such as mechanisms to add additional sections to the tubular member 116 as the wellbore 110 is drilled. A surface control unit 190, which may be a computer-based unit, is placed at the surface 167 for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and the reamer bit 160 rotate. The pilot bit 150 drills the first, smaller diameter borehole 142, while simultaneously the reamer bit 160 enlarges the borehole 142 to a second, larger diameter borehole 120. The earth's subsurface may contain rock strata made up of different rock structures that can vary from soft formations to very hard formations, and therefore the pilot bit 150 and/or the reamer bit 160 may be selected based on the formations expected to be encountered in a drilling operation.

Figure 2:
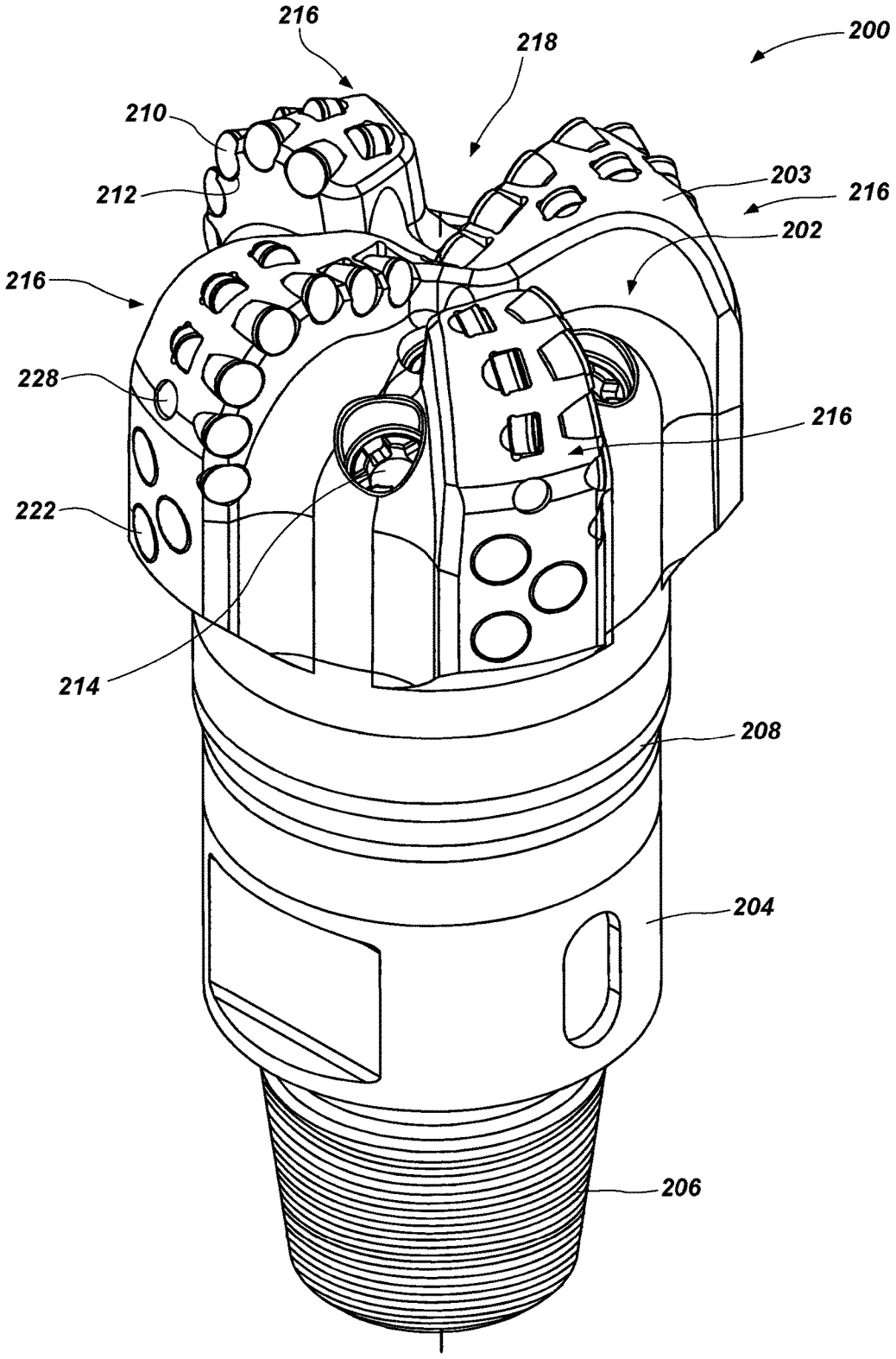
FIG. 2 is a simplified perspective view of a fixed-blade earth-boring rotary drill bit that may be used in conjunction with the drilling system of FIG. 1.

FIG. 2 is a perspective view of a fixed-cutter earth-boring rotary drill bit 200 that may be used in conjunction with the drilling system 100 of FIG. 1. For example, the drill bit 200 may be the pilot bit 150 shown in FIG. 1. The drill bit 200 includes a bit body 202 that may be secured to a shank 204 having a threaded connection portion 206 (e.g., an American Petroleum Institute (API) threaded connection portion) for attaching the drill bit 200 to a drill string (e.g., drill string 118, shown in FIG. 1). In some embodiments, the bit body 202 may be secured to the shank 204 using an extension 208. In other embodiments, the bit body 202 may be secured directly to the shank 204.

The bit body 202 may include internal fluid passageways that extend between the face 203 of the bit body 202 and a longitudinal bore, extending through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting element assemblies 210 may be mounted on the face 203 of the bit body 202 in cutting element pockets 212 that are located along each of the blades 216. The cutting element assemblies 210 may include PDC cutting elements, or may include other cutting elements. For example, some or all of the cutting element assemblies 210 may include rotatable cutters, as described below and shown in FIGS. 3-6.

Figure 3:
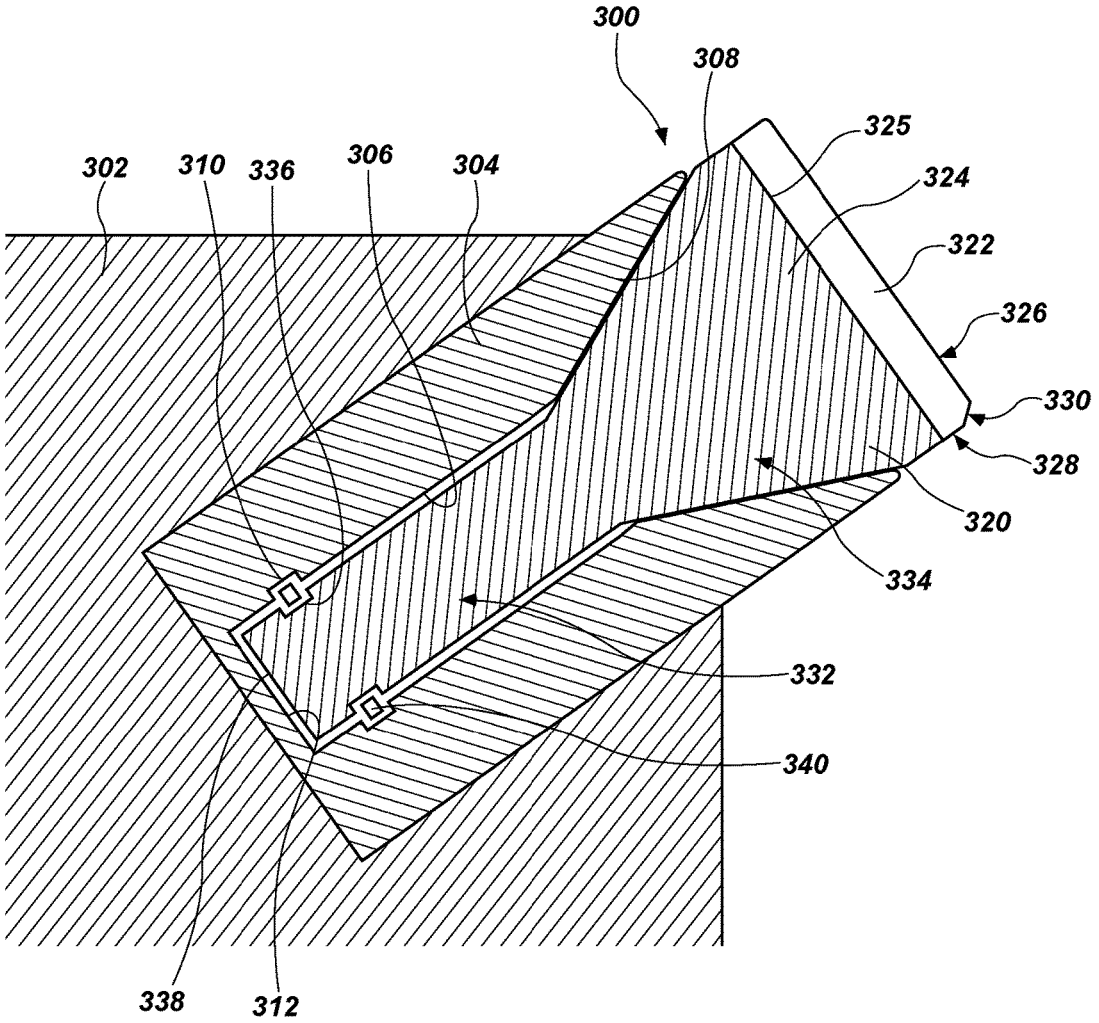
FIG. 3 is a simplified cross section showing a cutting element assembly mounted in a blade of an earth-boring tool, such as the rotary drill bit of FIG. 2.

FIG. 3 is a simplified cross section showing a cutting element assembly 300 mounted in a blade 302 of an earth-boring tool. The blade 302 may be, for example, one of the blades 216 shown in FIG. 2. The cutting element assembly 300 may be one of the cutting element assemblies 210 shown in FIG. 2.

The cutting element assembly 300 may include a sleeve 304 secured to the blade 302. For example, the sleeve 304 may be brazed or welded within a pocket of the blade 302. In other embodiments, the sleeve 304 may be integrally formed with the blade 302, such that there is no physical interface between the sleeve 304 and the blade 302.

The sleeve 304 may have a generally cylindrical interior surface 306 and a frustoconical interior surface 308, together defining a cavity in the sleeve 304. The sleeve 304 may have a groove 310, which may be, for example, a cylindrical channel sized and configured to receive an O-ring, a split ring, a beveled retaining ring, a bowed retaining ring, a spiral retaining ring, or another retaining element. The sleeve 304 may have an interior back surface 312, as shown on FIG. 3, such that the cavity formed by the surfaces 306, 308 is closed at one end by the interior back surface 312. In other embodiments, the interior back surface 312 may be absent, and the cavity formed by the surfaces 306, 308 may be bounded by the blade 302.

A rotatable cutting element 320 may be at least partially within the sleeve 304. The rotatable cutting element 320 may include a polycrystalline hard material 322 bonded to a substrate 324 at an interface 325. In other embodiments, the rotatable cutting element 320 may be formed entirely of the polycrystalline hard material 322, or may have another material in addition to the polycrystalline hard material 322 and the substrate 324. The polycrystalline hard material 322 may include diamond, cubic boron nitride, or another hard material. The substrate 324 may include, for example, cobalt-cemented tungsten carbide or another carbide material.

The polycrystalline hard material 322 may have an end cutting surface 326, and may also have other surfaces, such as a side surface 328, a chamfer 330, etc., which surfaces may be cutting surfaces intended to contact a subterranean formation. The polycrystalline hard material 322 may be generally cylindrical, and the interface 325 may be generally parallel to the end cutting surface 326.

The substrate 324 may have a generally cylindrical portion 332 and a frustoconical portion 334. The generally cylindrical portion 332 may be disposed within the generally cylindrical interior surface 306 of the sleeve 304, and may have a groove 336 sized and configured to receive an O-ring, a split ring, a beveled retaining ring, a bowed retaining ring, a spiral retaining ring, or another retaining element. For example, the groove 336 may have a width approximately equal to a width of the groove 310 in the sleeve 304. The frustoconical portion 334 of the substrate 324 may have a shape corresponding to the shape of the frustoconical interior surface 308 of the sleeve 304, such that when the rotatable cutting element 320 rotates within the sleeve 304, the frustoconical portion 334 of the substrate 324 is in sliding contact with the frustoconical interior surface 308 of the sleeve 304. The substrate 324 may have a back surface 338 perpendicular to an axis of rotation of the generally cylindrical portion 332 of the substrate 324. In some embodiments, the back surface 338 may be substantially parallel to the end cutting surface 326 of the polycrystalline hard material 322 and/or to the interface 325 between the polycrystalline hard material 322 and the substrate 324.

The back surface 338 of the substrate 324 and the interior back surface 312 of the sleeve 304 may together partially define a void between the substrate 324 and the sleeve 304. This void may prevent compressive longitudinal loads (or longitudinal components of loads) on the rotatable cutting element 320 from being transferred to the sleeve 304 through the interior back surface 312 (e.g., because there may not be contact between the interior back surface 312 of the sleeve 304 and the back surface 338 of the substrate 324). Instead, compressive longitudinal loads may be transferred substantially (e.g., entirely or almost entirely) via a bearing interface at which the frustoconical portion 334 of the substrate 324 contacts the frustoconical interior surface 308 of the sleeve 304.

The cutting element assembly 300 may also include a retention element 340 within the grooves 310, 336 to hold the rotatable cutting element 320 in the sleeve 304. The retention element 340 may be, for example, an O-ring, a split ring, a beveled retaining ring, a bowed retaining ring, a spiral retaining ring, a Belleville spring, or another retaining element. The retention element 340 may include a resilient material, and may be configured to spring into place, such that the rotatable cutting element 320 can be inserted into the sleeve 304 without deforming either the sleeve 304 or the rotatable cutting element 320. For example, if the retention element 340 is an O-ring, the rotatable cutting element 320 may be inserted into the sleeve 304 by compressing the O-ring in the groove 336. Once the rotatable cutting element 320 slides into position (e.g., a position in which the frustoconical portion 334 of the substrate 324 contacts the frustoconical interior surface 308 of the sleeve 304), the groove 336 in the substrate 324 may align with the groove 310 of the sleeve 304. At that point, the O-ring may decompress, such that the rotatable cutting element 320 cannot be removed from the sleeve 304 without compressing the O-ring again. Thus, the O-ring may provide sufficient force to retain the rotatable cutting element 320 within the sleeve 304 under normal operating conditions, but the rotatable cutting element 320 may still be removed from the sleeve 304 if necessary for repair.

Figure 4:
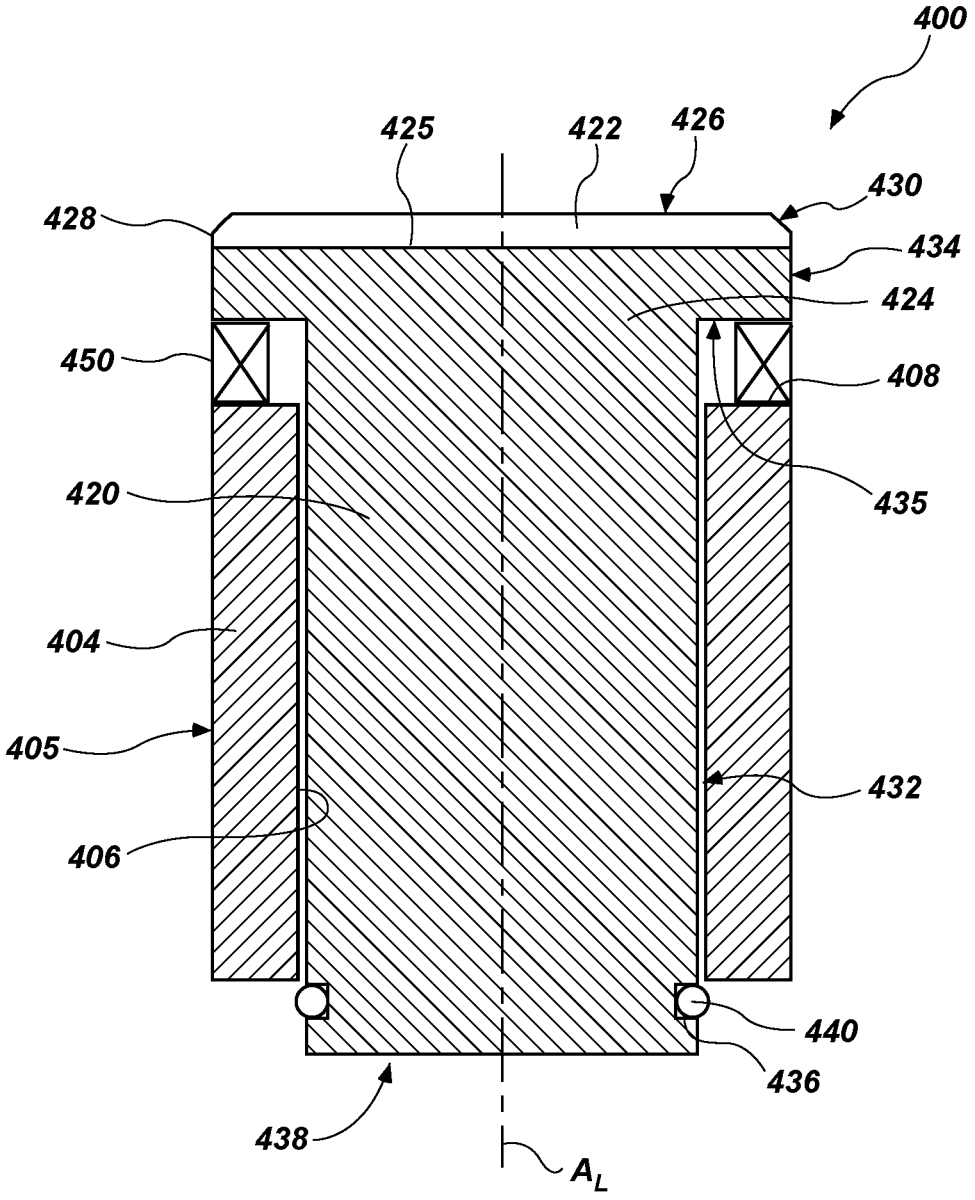
FIGS. 4-6 are simplified cross sections showing additional cutting element assemblies.

FIG. 4 is a simplified cross section showing a cutting element assembly 400. The cutting element assembly 400 may be one of the cutting element assemblies 210 shown in FIG. 2.

The cutting element assembly 400 may include a generally cylindrical sleeve 404, which may be secured to a blade 216 (FIG. 2). For example, an exterior surface 405 of the sleeve 404 may be brazed or welded within a pocket of the blade 216. In other embodiments, the sleeve 404 may be integrally formed with the blade 216, such that there is no physical interface between the sleeve 404 and the blade 216. The sleeve 404 may have a generally cylindrical interior surface 406 defining a cavity in the sleeve 404. The sleeve 404 may also have a generally planar upper surface 408.

A rotatable cutting element 420 may be at least partially within the sleeve 404. The rotatable cutting element 420 may include a polycrystalline hard material 422 bonded to a substrate 424 at an interface 425. In other embodiments, the rotatable cutting element 420 may be formed entirely of the polycrystalline hard material 422, or may have another material in addition to the polycrystalline hard material 422 and the substrate 424. The polycrystalline hard material 422 may include diamond, cubic boron nitride, or another hard material. The substrate 424 may include, for example, cobalt-cemented tungsten carbide or another carbide material.

The polycrystalline hard material 422 may have an end cutting surface 426, and may also have other surfaces, such as a side surface 428, a chamfer 430, etc., which surfaces may be cutting surfaces intended to contact a subterranean formation. The polycrystalline hard material 422 may be generally cylindrical, and the interface 425 may be generally parallel to the end cutting surface 426.

The substrate 424 may be generally cylindrical, with a first generally cylindrical surface 432 and a second generally cylindrical surface 434. A generally planar bearing surface 435 may intersect each of the first generally cylindrical surface 432 and a second generally cylindrical surface 434. The first generally cylindrical surface 432 may have a smaller diameter than the second generally cylindrical surface 434, and the surfaces 432, 434 may share a common axis of rotation, which may coincide with a longitudinal axis $A_L$ of the rotatable cutting element 420. Thus, the bearing surface 435 may be annular. In some embodiments, the bearing surface 435 may have approximately the same dimensions as the upper surface 408 of the sleeve 404. The bearing surface 435 may be generally parallel to the end cutting surface 426.

The rotatable cutting element 420, and particularly the substrate 424, may have a groove 436 sized and configured to receive O-ring, a split ring, a beveled retaining ring, a bowed retaining ring, a spiral retaining ring, or another retaining element. For example, the groove 436 may be configured such that when the rotatable cutting element 420 rotates within the sleeve 404, the first generally cylindrical surface 432 of the substrate 424 is in sliding contact with the generally cylindrical interior surface 406 of the sleeve 404. The substrate 424 may have a back surface 438 perpendicular to the longitudinal axis $A_L$ of rotatable cutting element 420. In some embodiments, the back surface 438 of the rotatable cutting element 420 may be substantially parallel to the end cutting surface 426 of the polycrystalline hard material 422, the interface 425 between the polycrystalline hard material 422 and the substrate 424, the upper surface 408 of the sleeve 404, and/or the bearing surface 435 of the rotatable cutting element 420.

A bearing element 450 may be disposed between the upper surface 408 of the sleeve 404 and the bearing surface 435 of the rotatable cutting element 420. The bearing element 450 may be any material capable of sustaining a compressive load applied to the rotatable cutting element 420. Compressive longitudinal loads may be transferred from the rotatable cutting element 420 to the sleeve 404 substantially (e.g., entirely or almost entirely) via the bearing element 450. The bearing element 450 may be a metal, an alloy, a ceramic, a hard material, a hard material coating on the surface of sleeve 404, etc. In some embodiments, the bearing element 450 may include a material having a composition similar or identical to the substrate 424 and/or the sleeve 404. In other embodiments, the bearing element 450 may include a material having a composition different from the substrate 424 and/or the sleeve 404. The bearing element 450 may have one or more polished surfaces to limit sliding friction and enable the rotatable cutting element 420 to freely rotate. In certain embodiments, the bearing element 450 may include a lubricant, a coating, or another feature to reduce friction. For example, the bearing element 450 may include a diamond-like coating. Diamond-like coatings are described in, for example, U.S. Patent Application Publication 2009/0321146, "Earth Boring Bit with DLC Coated Bearing and Seal," published Dec. 31, 2009, the entire disclosure of which is hereby incorporated herein by reference.

The cutting element assembly 400 may also include a retention element 440 within the groove 336 to hold the rotatable cutting element 420 in the sleeve 404. The retention element 440 may be, for example, an O-ring, a split ring, a beveled retaining ring, a bowed retaining ring, a spiral retaining ring, a Belleville spring, or another retaining element. The retention element 440 may include a resilient material, and may be configured to spring into place, such that the rotatable cutting element 420 can be inserted into the sleeve 404 without deforming either the sleeve 404 or the rotatable cutting element 420. For example, if the retention element 440 is an O-ring, the rotatable cutting element 420 may be inserted into the sleeve 404 by compressing the O-ring in the groove 436. Once the rotatable cutting element 420 slides into position (e.g., a position in which the bearing element 450 contacts the upper surface 408 of the sleeve 404 and the bearing surface 435 of the rotatable cutting element 420), the O-ring may decompress, such that the rotatable cutting element 420 cannot be removed from the sleeve 404 without compressing the O-ring again. Thus, the O-ring may provide sufficient force to retain the rotatable cutting element 420 within the sleeve 404 under normal operating conditions, but the rotatable cutting element 420 may still be removed from the sleeve 404 if necessary for repair.

Figure 5:
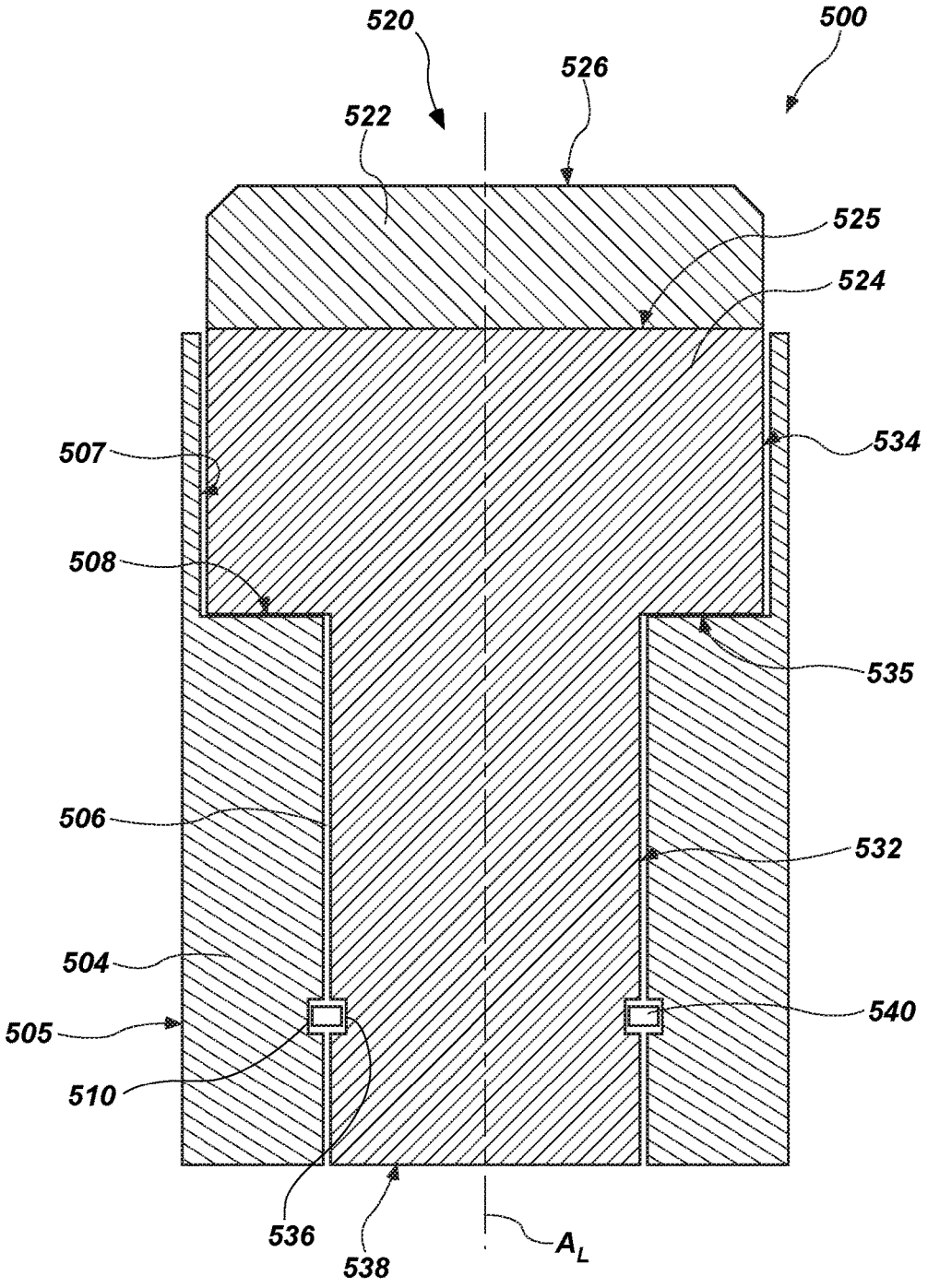

FIG. 5 is a simplified cross section showing a cutting element assembly 500. The cutting element assembly 500 may be one of the cutting element assemblies 210 shown in FIG. 2.

Figure 6:
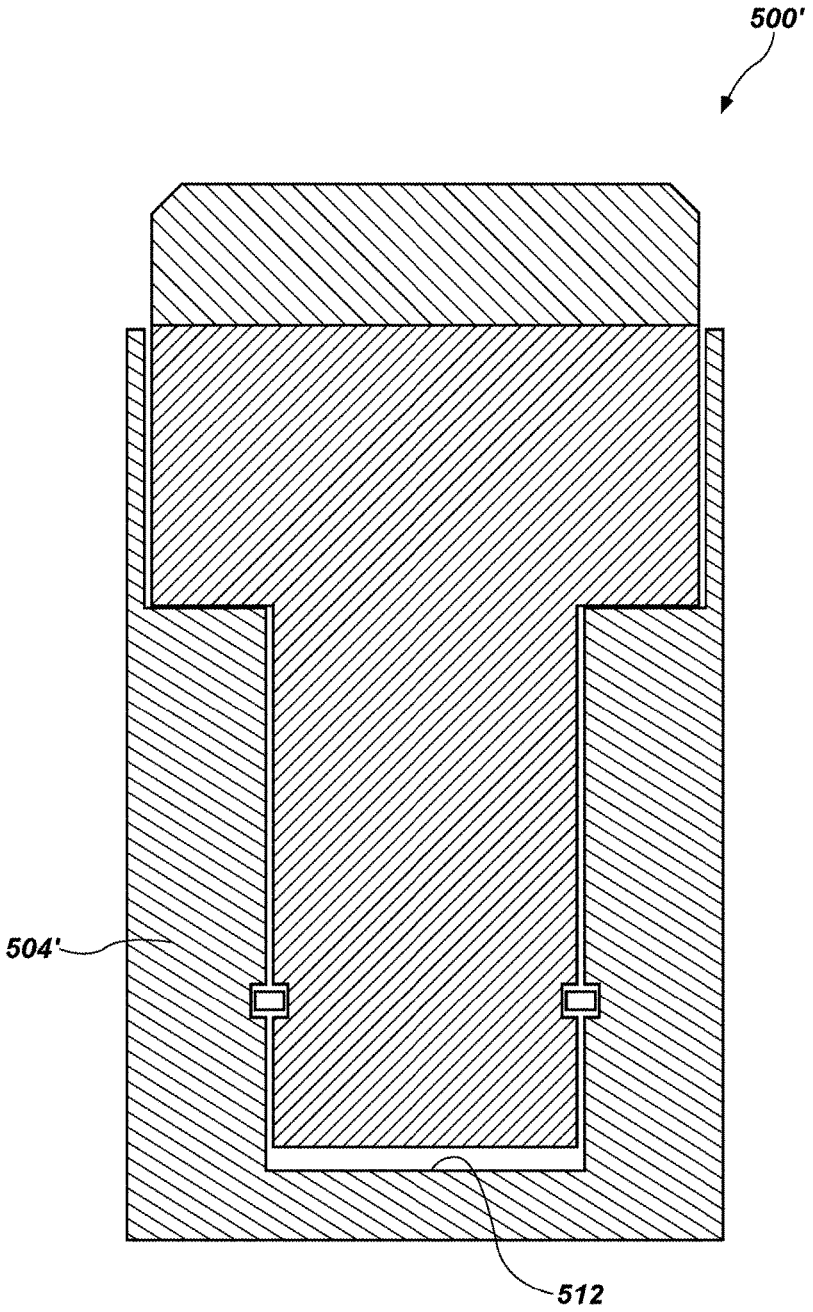

The cutting element assembly 500 may include a sleeve 504, which may be secured to a blade 216 (FIG. 2). For example, an exterior surface 505 of the sleeve 504 may be brazed or welded within a pocket of the blade 216. In other embodiments, the sleeve 504 may be integrally formed with the blade 216, such that there is no physical interface between the sleeve 504 and the blade 216. The sleeve 504 may have a first generally cylindrical interior surface 506, a second generally cylindrical interior surface 507, and a generally planar axial bearing surface 508, which may together at least partially define a cavity in the sleeve 504. The cavity may extend through the sleeve, as shown in FIG. 5. In some embodiments, and in a cutting element assembly 500' as shown in FIG. 6, a sleeve 504' may define an interior back surface 512 that also partially defines a cavity in the sleeve 504'.

A rotatable cutting element 520 may be at least partially within the sleeve 504. The rotatable cutting element 520 may include a polycrystalline hard material 522 bonded to a substrate 524 at an interface 525, which may be configured similar to the polycrystalline hard material 422 and substrate 424 shown in FIG. 4 and described above.

The substrate 524 may be generally cylindrical, with a first generally cylindrical surface 532 and a second generally cylindrical surface 534. A generally planar bearing surface 535 may intersect each of the first generally cylindrical surface 532 and a second generally cylindrical surface 534. The first generally cylindrical surface 532 may have a smaller diameter than the second generally cylindrical surface 534, and the surfaces 532, 534 may share a common axis of rotation, which may coincide with a longitudinal axis $A_L$ of the rotatable cutting element 520. Thus, the bearing surface 535 may be annular. In some embodiments, the bearing surface 535 may have approximately the same dimensions as the bearing surface 508 of the sleeve 504. The bearing surface 535 may be generally parallel to an end cutting surface 526 of the rotatable cutting element 520. In some embodiments, a bearing element, such as the bearing element 450 shown in FIG. 4, may be between the bearing surfaces 508, 535.

The rotatable cutting element 520 may have a back surface 538 perpendicular to the longitudinal axis $A_L$ of the rotatable cutting element 520. In some embodiments, the back surface 538 of the rotatable cutting element 520 may be substantially parallel to the end cutting surface 526 of the rotatable cutting element 520, the bearing surface 508 of the sleeve 504, and/or the bearing surface 535 of the rotatable cutting element 520.

Portions of the rotatable cutting element 520 may be disposed within the interior of each of the first generally cylindrical interior surface 506 and the second generally cylindrical interior surface 507 of the sleeve 504. That is, when the rotatable cutting element 520 rotates within the sleeve 504, the first generally cylindrical surface 532 of the rotatable cutting element 520 may be in sliding contact with the interior surface 506 of the sleeve 504. In addition, the second generally cylindrical surface 534 of the rotatable cutting element 520 may be in sliding contact with the interior surface 507.

The back surface 538 of the rotatable cutting element 520 and blade 216 (FIG. 2) or the interior back surface 512 of the sleeve 504' (FIG. 6) may together partially define a void adjacent the rotatable cutting element 520. This void may prevent compressive longitudinal loads on the rotatable cutting element 520 from being transferred to the sleeve 504, 504' through the back surface 538. Instead, compressive longitudinal loads may be transferred substantially (e.g., entirely or almost entirely) via an axial bearing interface at which the bearing surface 535 of the rotatable cutting element 520 contacts the bearing surface 508 of the sleeve 504. In embodiments in which a bearing element is between the bearing surfaces 508, 535, compressive loads may be transferred via the bearing element.

The rotatable cutting element 520 may have a groove 536 sized and configured to receive a retention element 540, which may be configured similar to the groove 336, shown in FIG. 3, or the groove 436, shown in FIG. 4. For example, and as shown in FIG. 5, the sleeve 504 may define a groove 510 therein, and when the rotatable cutting element 520 is disposed within the sleeve 504, the groove 536 in the rotatable cutting element 520 may align with the groove 510 of the sleeve 504.

Rotatable cutting elements assemblies as disclosed herein may have certain advantages over conventional rotatable cutting elements and over conventional fixed cutting elements. For example, sleeves may be installed into a bit body (e.g., by brazing) before the rotatable cutting elements are installed into the sleeves. Thus, the rotatable cutting elements, and particularly the PDC tables, need not be exposed to the high temperatures typical of brazing. Thus, installing rotatable cutting elements into sleeves already secured to a bit body may avoid thermal damage caused by brazing. Furthermore, rotatable cutting elements as disclosed herein may be removed easily and replaced, such as when the cutting elements are worn or damaged. Separation of rotatable cutting element from a sleeve secured by retention elements may be trivial in comparison to removal of cutting elements or sleeves brazed into a bit body. For example, rotatable cutting elements may be removed by applying tension (i.e., a pulling force) to the cutting elements. Similarly, insertion of a new cutting element may be effected rapidly and without reheating of the drill bit. Thus, drill bits may be more quickly repaired than drill bits having conventional cutting elements.

Additional nonlimiting example embodiments of the disclosure are described below.

Embodiment 1

A cutting element assembly comprising a sleeve, a rotatable cutting element disposed within the sleeve, and a retention element. The sleeve defines a first internal groove and a first frustoconical surface longitudinally spaced from the first internal groove. The rotatable cutting element comprises a polycrystalline hard material and a supporting substrate. The polycrystalline hard material has an end cutting surface. The rotatable cutting element defines a second groove in a surface of the supporting substrate and a second frustoconical surface longitudinally spaced from the second internal groove. The retention element is disposed partially within the first groove and partially within the second groove.

Embodiment 2

The cutting element assembly of Embodiment 1, wherein the rotatable cutting element defines an interior back surface parallel to the end cutting surface, and wherein the sleeve and the rotatable cutting element define a void adjacent the interior back surface.

Embodiment 3

The cutting element assembly of Embodiment 1 or Embodiment 2, wherein the sleeve further defines an interior cylindrical surface, wherein the substrate of the rotatable cutting element comprises a cylindrical portion, and wherein the cylindrical portion of the substrate is disposed within the interior cylindrical surface of the sleeve.

Embodiment 4

The cutting element assembly of any of Embodiments 1 through 3, wherein the first frustoconical surface is in rotational sliding contact with the second frustoconical surface.

Embodiment 5

The cutting element assembly of any of Embodiments 1 through 4, wherein the retention element comprises an elastomeric material.

Embodiment 6

The cutting element assembly of any of Embodiments 1 through 5, wherein the retention element comprises a metal.

Embodiment 7

The cutting element assembly of any of Embodiments 1 through 6, wherein the retention element comprises at least one selected from the group consisting of an O-ring, a split ring, a beveled retaining ring, a bowed retaining ring, a spiral retaining ring, and a Belleville spring.

Embodiment 8

The cutting element assembly of any of Embodiments 1 through 7, wherein the substrate defines the second groove and the second frustoconical surface.

Embodiment 9

A cutting element assembly comprising a sleeve defining a cylindrical cavity therein and a rotatable cutting element disposed at least partially within the cavity of the sleeve. The sleeve defines a generally planar end surface. The rotatable cutting element comprises a polycrystalline hard material bonded to a substrate. The polycrystalline hard material has an end cutting surface generally parallel to the end surface of the sleeve. The substrate defines a bearing surface and a cylindrical portion extending into the cylindrical cavity of the sleeve. The bearing surface is opposite the end cutting surface. A bearing element is between the end surface of the sleeve and the bearing surface of the rotatable cutting element.

Embodiment 10

The cutting element assembly of Embodiment 9, wherein the substrate further defines a groove in the cylindrical portion, and further comprising a retention element disposed partially within the groove and extending radially beyond an inner surface of the cylindrical cavity.

Embodiment 11

The cutting element assembly of Embodiment 10, wherein the retention element comprises at least one selected from the group consisting of an O-ring, a split ring, a beveled retaining ring, a bowed retaining ring, a spiral retaining ring, and a Belleville spring.

Embodiment 12

The cutting element assembly of Embodiment 10 or Embodiment 11, wherein the retention element comprises at least one material selected from the group consisting of elastomeric materials, metals, and alloys.

Embodiment 13

The cutting element assembly of any of Embodiments 9 through 12, wherein when a compressive longitudinal load is applied to the end cutting surface of the polycrystalline hard material of the rotatable cutting element, the compressive longitudinal load is transferred to the sleeve substantially via the bearing element.

Embodiment 14

A cutting element assembly comprising a sleeve and a rotatable cutting element. The sleeve defines a first interior cylindrical surface, a second interior cylindrical surface, and a generally planar axial bearing surface between the first interior cylindrical surface and the second interior cylindrical surface. The first interior cylindrical surface, the axial bearing surface, and the second interior cylindrical surface together at least partially define a cavity in the sleeve. The rotatable cutting element is disposed at least partially within the cavity. The rotatable cutting element comprises a polycrystalline hard material mounted to a substrate and having an end cutting surface generally parallel to the axial bearing surface of the sleeve. The substrate defines a first generally cylindrical surface, a second generally cylindrical surface, and an axial bearing surface opposite the end cutting surface and extending between the first generally cylindrical surface and the second generally cylindrical surface. The substrate is substantially disposed within an interior of each of the first interior cylindrical surface and the second interior cylindrical surface, and the axial bearing surface of the rotatable cutting element is in contact with the axial bearing surface of the sleeve.

Embodiment 15

The cutting element assembly of Embodiment 14, wherein the substrate further defines a groove, and further comprising a retention element disposed at least partially within the groove and extending radially outward therefrom.

Embodiment 16

The cutting element assembly of Embodiment 15, wherein the retention element comprises at least one selected from the group consisting of an O-ring, a split ring, a beveled retaining ring, a bowed retaining ring, a spiral retaining ring, and a Belleville spring.

Embodiment 17

The cutting element assembly of Embodiment 15 or Embodiment 16, wherein the retention element comprises at least one material selected from the group consisting of elastomeric materials, metals, and alloys.

Embodiment 18

The cutting element assembly of any of Embodiments 15 through 17, wherein the sleeve defines another groove, and wherein the retention element is partially disposed within the another groove.

Embodiment 19

The cutting element assembly of any of Embodiments 14 through 18, wherein when a compressive longitudinal load is applied to the end cutting surface of the polycrystalline hard material of the rotatable cutting element, the compressive longitudinal load is transferred to the sleeve substantially via the axial bearing interface.

Embodiment 20

The cutting element assembly of any of Embodiments 14 through 19, wherein the cavity extends through the sleeve.

Embodiment 21

The cutting element assembly of any of Embodiments 14 through 20, wherein the sleeve defines a back surface of the cavity.

Embodiment 22

The cutting element assembly of any of Embodiments 1 through 21, wherein the sleeve comprises a carbide.

Embodiment 23

The cutting element assembly of any of Embodiments 1 through 22, wherein the sleeve defines a cylindrical exterior surface.

Embodiment 24

An earth-boring tool comprising a bit body and the cutting assembly of any of Embodiments 1 through 23. The sleeve of the cutting element assembly is secured to the bit body.

Embodiment 25

The earth-boring tool of Embodiment 24, wherein the sleeve is brazed into a pocket defined by the bit body.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A cutting element assembly, comprising:

a sleeve defining a first internal groove and a first frustoconical surface longitudinally spaced from the first internal groove;

a rotatable cutting element disposed within the sleeve, the rotatable cutting element comprising a polycrystalline hard material and a supporting substrate, wherein the polycrystalline hard material has an end cutting surface, wherein the rotatable cutting element defines a second internal groove in a surface of the supporting substrate and a second frustoconical surface longitudinally spaced from the second internal groove;

wherein the first frustoconical surface and the second frustoconical surface are in direct sliding contact such that compressive loads are transferred substantially via a bearing interface at which the first frustoconical surface contacts the second frustoconical surface;

wherein the rotatable cutting element also defines an interior planar back surface parallel to the end cutting surface, and wherein a generally planar end surface of the sleeve and the interior planar back surface parallel to the end cutting surface define a void adjacent the interior planar back surface; and a retention element disposed partially within the first internal groove and partially within the second groove such that the retention element provides sufficient force to retain the rotatable cutting element within the sleeve under normal operating conditions.

2. The cutting element assembly of claim 1, wherein the sleeve further defines an interior cylindrical surface, wherein the supporting substrate of the rotatable cutting element comprises a cylindrical portion, and wherein the cylindrical portion of the supporting substrate is disposed within the interior cylindrical surface of the sleeve.

3. The cutting element assembly of claim 1, wherein the retention element comprises an elastomeric material.

4. The cutting element assembly of claim 1, wherein the retention element comprises a metal.

5. The cutting element assembly of claim 1, wherein the retention element comprises at least one selected from the group consisting of an O-ring, a split ring, a beveled retaining ring, a bowed retaining ring, a spiral retaining ring, and a Belleville spring.

6. The cutting element assembly of claim 1, wherein the supporting substrate defines the second groove and the second frustoconical surface.

7. A cutting element assembly, comprising:

a sleeve defining a first interior cylindrical surface, a second interior cylindrical surface, and a generally planar axial bearing surface between the first interior cylindrical surface and the second interior cylindrical surface, wherein the first interior cylindrical surface, the generally planar axial bearing surface, and the second interior cylindrical surface together at least partially define a cavity in the sleeve;

a rotatable cutting element disposed at least partially within the cavity, the rotatable cutting element comprising a polycrystalline hard material having an end cutting surface generally parallel to the axial bearing surface of the sleeve and mounted to a substrate, wherein the rotatable cutting element also defines an interior back surface parallel to the end cutting surface, and wherein a generally planar end surface of the sleeve and the interior back surface parallel to the end cutting surface define a void adjacent the interior back surface;

the substrate defining a first generally cylindrical surface, a second generally cylindrical surface, and an axial bearing surface opposite the end cutting surface and extending between the first generally cylindrical surface and the second generally cylindrical surface;

wherein the substrate is substantially disposed within and is in sliding contact with both an interior of each of the first interior cylindrical surface and the second interior cylindrical surface with the axial bearing surface of the rotatable cutting element in sliding contact with the axial bearing surface of the sleeve.

8. The cutting element assembly of claim 7, wherein the substrate further defines a groove, and further comprising a retention element disposed at least partially within the groove and extending radially outward therefrom.

9. The cutting element assembly of claim 8, wherein the retention element comprises at least one selected from the group consisting of a split ring, a beveled retaining ring, a bowed retaining ring, a spiral retaining ring, and a Belleville spring.

10. The cutting element assembly of claim 9, wherein the sleeve defines another groove, and wherein the retention element is partially disposed within the another groove.

11. The cutting element assembly of claim 7, wherein when a compressive longitudinal load is applied to the end cutting surface of the polycrystalline hard material of the rotatable cutting element, the compressive longitudinal load is transferred to the sleeve substantially via the axial bearing surface.

* * * * *